United States Patent [19]

Larralde

[11] 3,936,034

[45] Feb. 3, 1976

[54] BALANCED HOIST APPARATUS

[75] Inventor: Edward Larralde, Santa Barbara, Calif.

[73] Assignee: Vetco Offshore Industries, Inc., Ventura, Calif.

[22] Filed: Apr. 8, 1974

[21] Appl. No.: 458,657

[52] U.S. Cl. ..... 254/188; 254/190 R

[51] Int. Cl.[2] ..... B66D 3/04

[58] Field of Search ..... 254/188, 189, 139, 172, 254/190, 191; 175/5, 27

[56] References Cited

UNITED STATES PATENTS

| | | | |
|---|---|---|---|
| 1,828,897 | 10/1931 | Hollingsworth | 254/188 |
| 2,239,493 | 4/1941 | Nichols | 254/188 |
| 3,258,249 | 6/1966 | Williams | 254/188 |
| 3,658,298 | 4/1972 | Moore et al. | 254/190 R |
| 3,834,672 | 9/1974 | Hawley et al. | 254/172 |

*Primary Examiner*—Robert J. Spar
*Assistant Examiner*—Kenneth Noland
*Attorney, Agent, or Firm*—Bernard Kriegel

[57] ABSTRACT

The traveling block of the derrick mounted on a floating barge is connected in off-center relation with a load supporting motion compensator cylinder, the sheaves being located and strung asymmetrically with respect to the center line of the motion compensator cylinder. The crown block sheaves are rotatable on axes which are skewed to reduce fleet angle of the line. Different size sheaves are strung differently and different numbers of line runs are strung differently to equalize the forces about the center of gravity of the mass of the traveling block.

15 Claims, 14 Drawing Figures

C9
C5
C4
C3
C2
C1
C8
C7
C6
6
6
19
FL
L
T
T1
T2
T3
T4
T5
T6
T7
T8
20
DL
DW
A

FL
A3
C9
DL
T5
19
C1
C4
C5
C8
C2
C3
C6
C7

FL
C9
A3
DL
19
C1
C4
C5
C8
C2
C3
C6
C7

12
12
C1
C2
C3
C4
C5
C6
C7
C8
C9
FL
19
T1
T2
T3
T4
T5
T6
T7
T8
T
L
20
DL
DW
A

BALANCED HOIST APPARATUS

In the operation of hoistline equipment, such as well drilling derricks and hoists in general employing multiple runs of a line between the sheaves of a fixed block and a traveling block, the forces are normally not equalized about the center of gravity of the mass of the traveling block due to the differences in the forces applied to the sheaves by the different line runs. A typical well drilling derrick has a number of crown block sheaves and the traveling block has a number of sheaves over which is strung a hoist line which is unwound from and wound on a drawworks drum, with the dead end of the line anchored to a dead man or "dead line" anchor. The line between the drawworks and the first crown block sheave is the "fast line." Under working conditions, the fast line exerts a greater force on the traveling block than does the dead line, and the intermediate lines exert forces on the traveling block proportional to their positions in the line system. Such unbalanced forces should be compensated for, particularly where heavy loads are involved, such as is the case with well drilling derricks.

The problem is aggravated in the case of well drilling derricks which are mounted on floating vessels or barges and have motion compensating means including a large cylinder integrated with the traveling block and extending vertically through the traveling block body and extending upwardly between sets of sheaves spaced at opposite sides of the cylinder, such traveling blocks being known as "split" traveling blocks. In the operation of such derricks, the motion compensating cylinder, at times when the traveling block is fully elevated, extends upwardly through the water table of the derrick and between the spaced sheaves of a split crown block. Such a derrick motion compensating cylinder and split traveling block, and split crown block is the subject of the pending application for United States Letters Patent Ser. No. 274,880, filed July 25, 1972, for "HYDRAULIC MOTION COMPENSATING APPARATUS."

With the axes of the spaced crown block sheaves aligned at opposite sides of the split crown block, the fleet angle of the lines when the traveling block is fully elevated can cause substantial friction and line wear which is costly and energy consuming.

The present invention provides balanced hoist apparatus which obviates the problems referred to above.

More particularly, the present invention provides a traveling block which is split and supports a motion compensating cylinder in off-center or asymmetrical relation to the traveling block sheaves to substantially equalize the forces about the center of gravity of the mass of the traveling block and compensator cylinder assembly, when the lines are strung asymmetrically and in various numbers in a manner related to the relative force applied to the traveling block sheaves, as referred to above, the greatest force being applied by the fast line and the least force being applied by the dead line.

In addition, the split crown block sheaves are rotatable on axes which are skewed, rather than aligned, and a crossover sheave is selected to minimize the fleet angle of the lines, thereby reducing line wear.

This invention possesses many other advantages, and has other purposes which may be made more clearly apparent from a consideration of the forms in which it may be embodied. These forms are shown in the drawings accompanying and forming part of the present specification. They will now be described in detail, for the purpose of illustrating the general principals of the invention; but it is to be understood that such detailed descriptions are not to be taken in a limiting sense.

Figure 1:
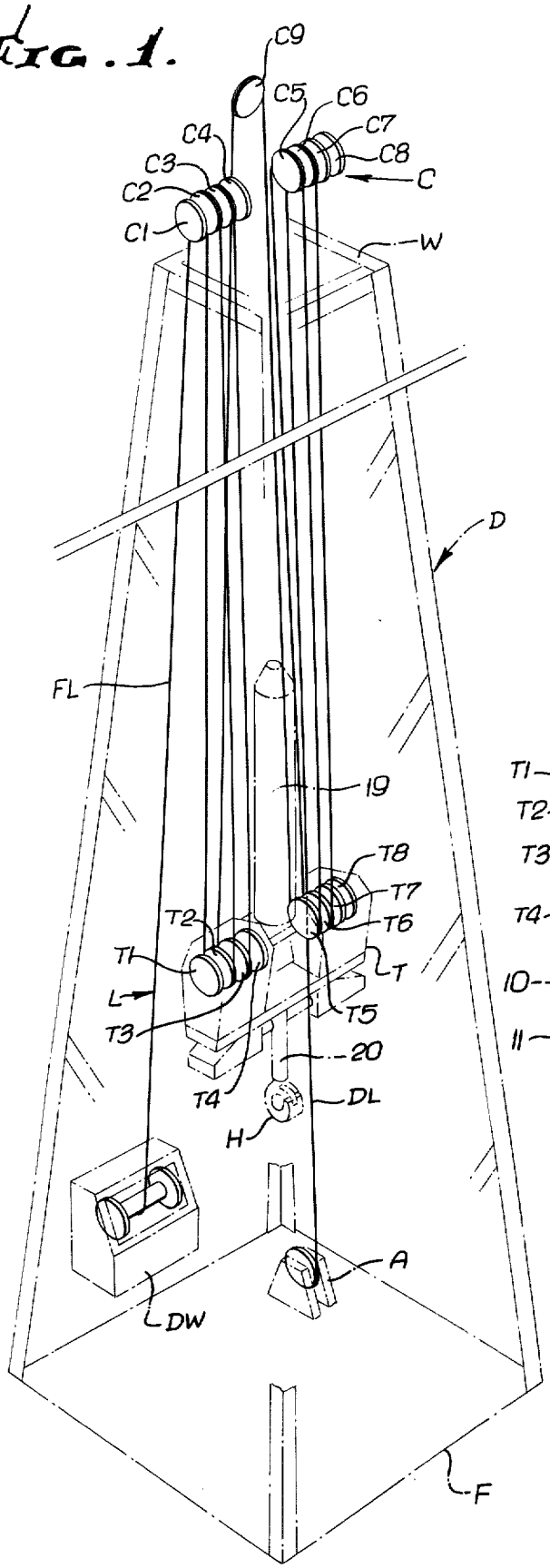
FIG. 1 is a perspective view schematically illustrating a derrick equipped with the balanced hoist apparatus of the invention.

As seen in the drawings referring first to FIG. 1, the balanced hoist apparatus of the invention is shown as incorporated in a well drilling derrick D, the floor F of which may be on a floating vessel or barge for drilling wells, such as oil and gas wells, at offshore locations, where the vessel or barge is subject to motion caused by tide and wave action. The derrick has a drawworks DW adapted to pull in and pay out a cable or line L which is strung through a crown block C mounted on the water table W of the derrick and through a traveling block T from which depends a hook H adapted to support a load, such as a string of drill pipe, with the end of the line fixed to the derrick floor by an anchor or dead man A. When the line L is pulled in by the drawworks drum the hook H is elevated by the traveling block T, and conversely, when the line L is payed off by the drawworks drum, the hook H is lowered in the derrick. The line L which extends between the drawworks drum and the crown block is a "fast line" FL, and the line leading between the crown block and the anchor A is a "dead line" DL.

The crown block C as diagrammatically illustrated comprises a set or plurality of sheaves C1, C2, C3 and C4 mounted for rotation on a horizontal axis at one side of the crown block, and another set or plurality of sheaves C5, C6, C7 and C8 mounted for rotation on a horizontal axis at the other side of the crown block, as well as an intermediate crossover sheave C9 located between the sets of sheaves and on a horizontal axis at right angles to and spaced above the axes of the sheaves C1 through C8. Correspondingly, the traveling block T has at one side a set of sheaves T1, T2, T3 and T4 mounted for rotation on a horizontal axis at one side of the traveling block, and another set of sheaves T5, T6, T7 and T8 mounted for rotation on a horizontal axis at the other side of the traveling block. The line L is reaved about the selected sheaves of the crown block and about the selected sheaves of the traveling block, as will be later described.

Figure 2:
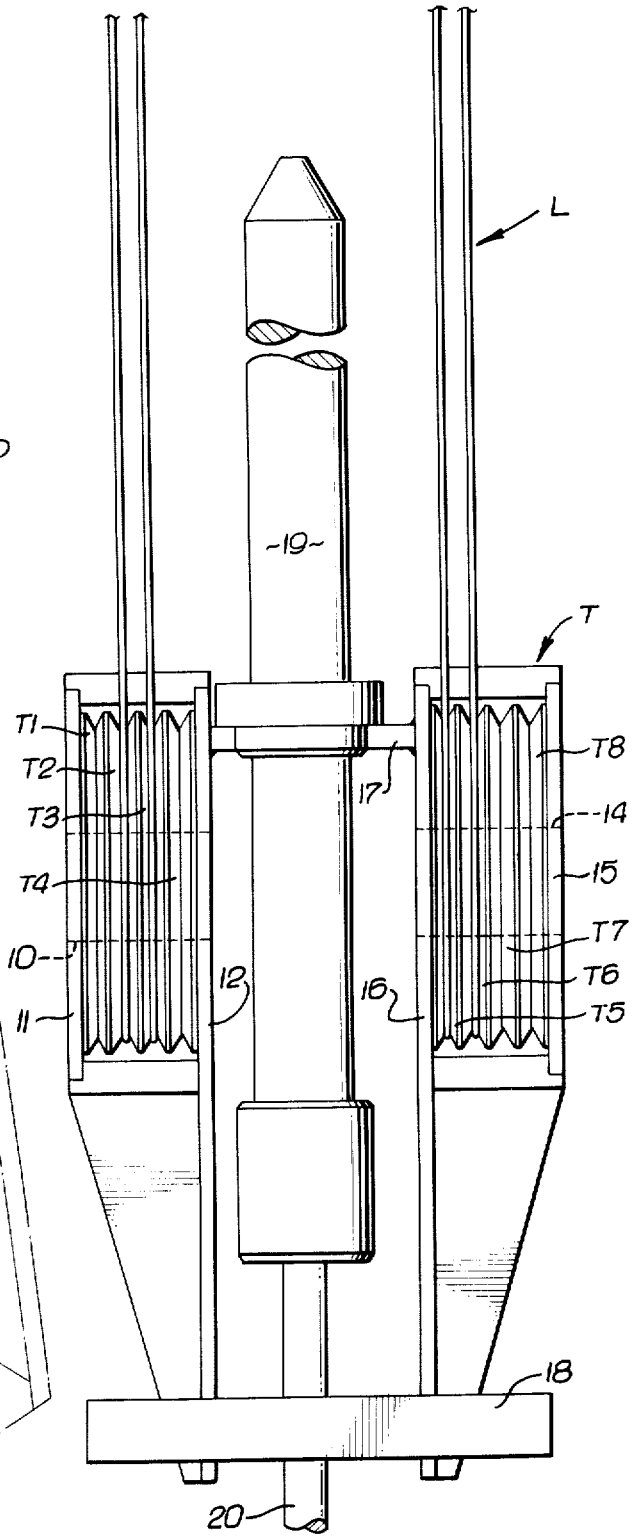
FIG. 2 is a side elevation of the asymmetrical traveling block and motion compensating cylinder assembly of the invention.

As seen in FIG. 2, the traveling block has the set of sheaves T1 through T4 mounted for rotation about a supporting shaft 10 which is suitably mounted in a left-hand supporting frame structure 11 including a vertical plate 12 at the inner side of the sheaves, and correspondingly, the sheaves of the right-hand set of sheaves T5 through T8 are mounted on a shaft 14 carried by a right-hand supporting frame structure 15 including an inner supporting plate 16 which is disposed in laterally spaced relation to the plate 12. Extending horizontally between the plates 12 and 16 is an upper support member 17 and a lower support member 18 which interconnect the frame structures 11 and 15. Carried by the horizontal members 17 and 18 is the load supporting means including a motion compensating cylinder assembly comprising an elongated cylinder 19 extending upwardly above the top of the traveling block and extending downwardly between the plates 12 and 16. Extending downwardly from the cylinder 19 is a piston rod 20 which is suitably connected at its lower end to the hook H in a well known manner not requiring illustration. The details of the motion compensating cylinder means are not germane to the present invention. Representative motion compensating means is more particularly disclosed in the aforesaid application for United States Letters Patent. As shown in that application, the motion compensator cylinder is mounted between the two side frame structures of the traveling block in a central location equally spaced from the sets of sheaves in the traveling block. In accordance with the present invention, the load supporting means, i.e., the cylinder 19 and the piston rod 20 are off-set to one side of the center of the traveling block assembly so that the line L can be selectively strung about the crown and traveling block sheaves in such a manner, determined by the diameter of the sheaves and the number of lines which are to support the load, that the different forces applied to the respective traveling block sheaves do not cause an imbalance. Instead, the forces are substantially equalized about the center of gravity of the mass of the traveling block and load supporting motion compensating means.

The forces applied to the traveling block by the lines extending about the traveling block sheaves vary and are influenced by the following factors:

a. Static load b. Dynamic (due to flexure of line)

c. Dynamic - acceleration

In the above case loads *a* and *b* are additive and their sign is always plus. Load *c* is additive but may be plus or minus depending on the direction of travel of the traveling block. In view of the above the spacing of the sheaves and the consequent reeving of the wire line is a matter of selecting the prevailing or morst significant operating mode.

Figure 3:
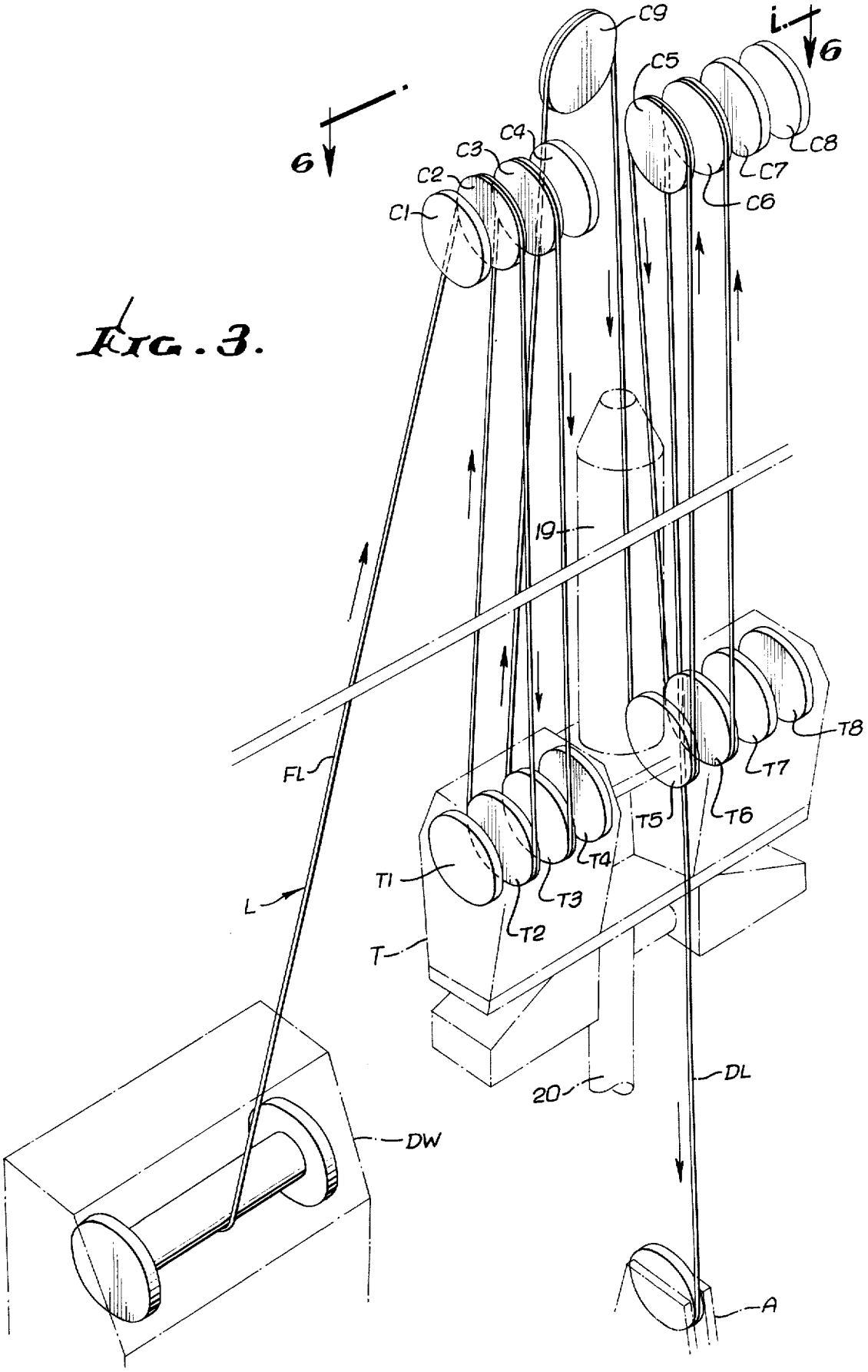
FIG. 3 is a diagrammatic illustration showing the balanced hoist apparatus strung with eight lines between the crown block and traveling block sheaves with sheaves of one particular diameter.

As seen in FIG. 3, the line L is strung about the crown block and traveling block sheaves in the same manner generally seen in FIGS. 1 and 2, so that the load suspended by the load compensating means and the traveling block is supported by eight line runs extending between the crown block and traveling block. The manner in which the line is strung in FIG. 3 has been determined to produce the desired balancing result when the crown block and traveling block sheaves are 54 inches in diameter. In this form the fast line extends upwardly over the crown block sheave C2, downwardly about the traveling block sheave T2, thence upwardly and over the crown block sheave C3, and downwardly about the traveling block sheave T3, then upwardly about the crossover sheave C9 to the right-hand side of the crown block, downwardly about the inner traveling block sheave T5, upwardly over the crown block sheave C5, then downwardly about the traveling block sheave T6, upwardly about the crown block sheave C6, and then to the dead line anchor A. In this scheme, the load is supported by equal numbers of lines on sheaves T2 and T3, at the left-hand side of the load supporting means cylinder 19, and T5 and T6, at the right-hand side of the load supporting means cylinder 19, which are substantially equally laterally spaced from the center of the asymmetrically disposed load supporting means cylinder, so that the forces are substantially equalized about the center of gravity of the mass of the traveling block.

Figure 6:
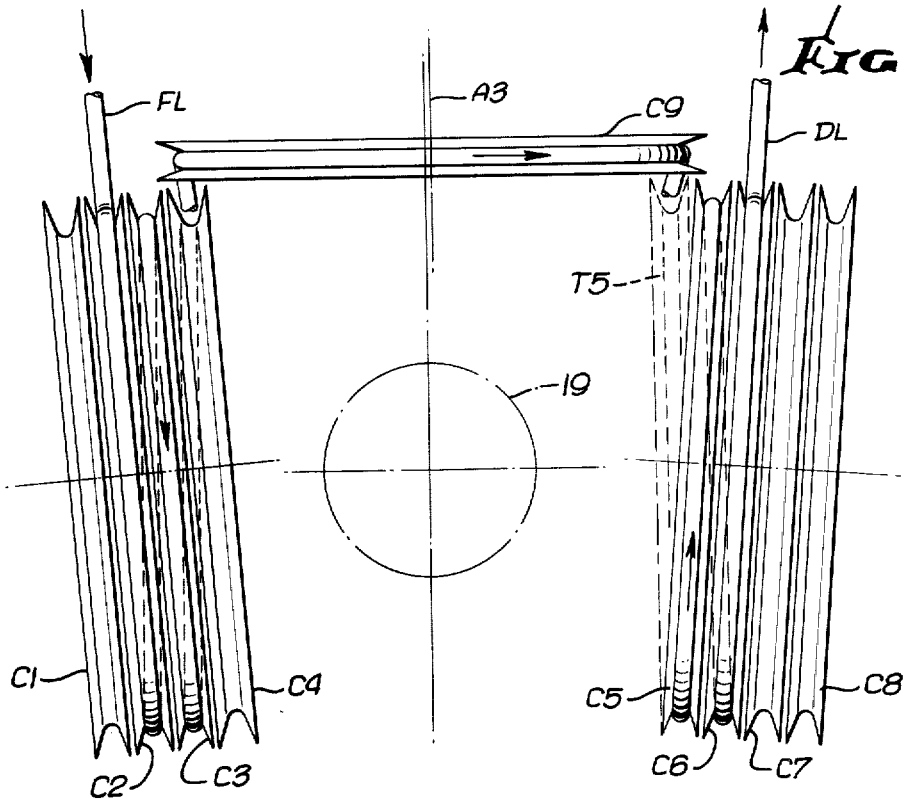
FIG. 6 is a diagrammatic top plan of the crown block strung as in FIG. 3, and taken on the line 6—6 of FIG. 3.

In order to minimize the fleet angle of the line running between the traveling block sheaves and the crossover sheave 9, the axes of the sheaves C1 through C4 and C5 through C8 are skewed in a horizontal plane, so that the plane of the respective crown block sheaves is not normal to the plane of the crossover sheave C9, but instead the crown block sheaves are at angles convergent in a direction away from the crossover sheave C9. In this form, with the apparatus strung with 8 lines between the traveling block and crown block sheaves, the axis A3 of the crossover sheave 9 is slightly off-set horizontally with respect to the center line of the motion compensating cylinder 19 in the direction of the right-hand set of crown block sheaves, as seen in FIG. 6, and the crossover sheave C9 is of a diameter such as to minimize fleet angle of the line, thereby minimizing line flexure.

Figure 4:
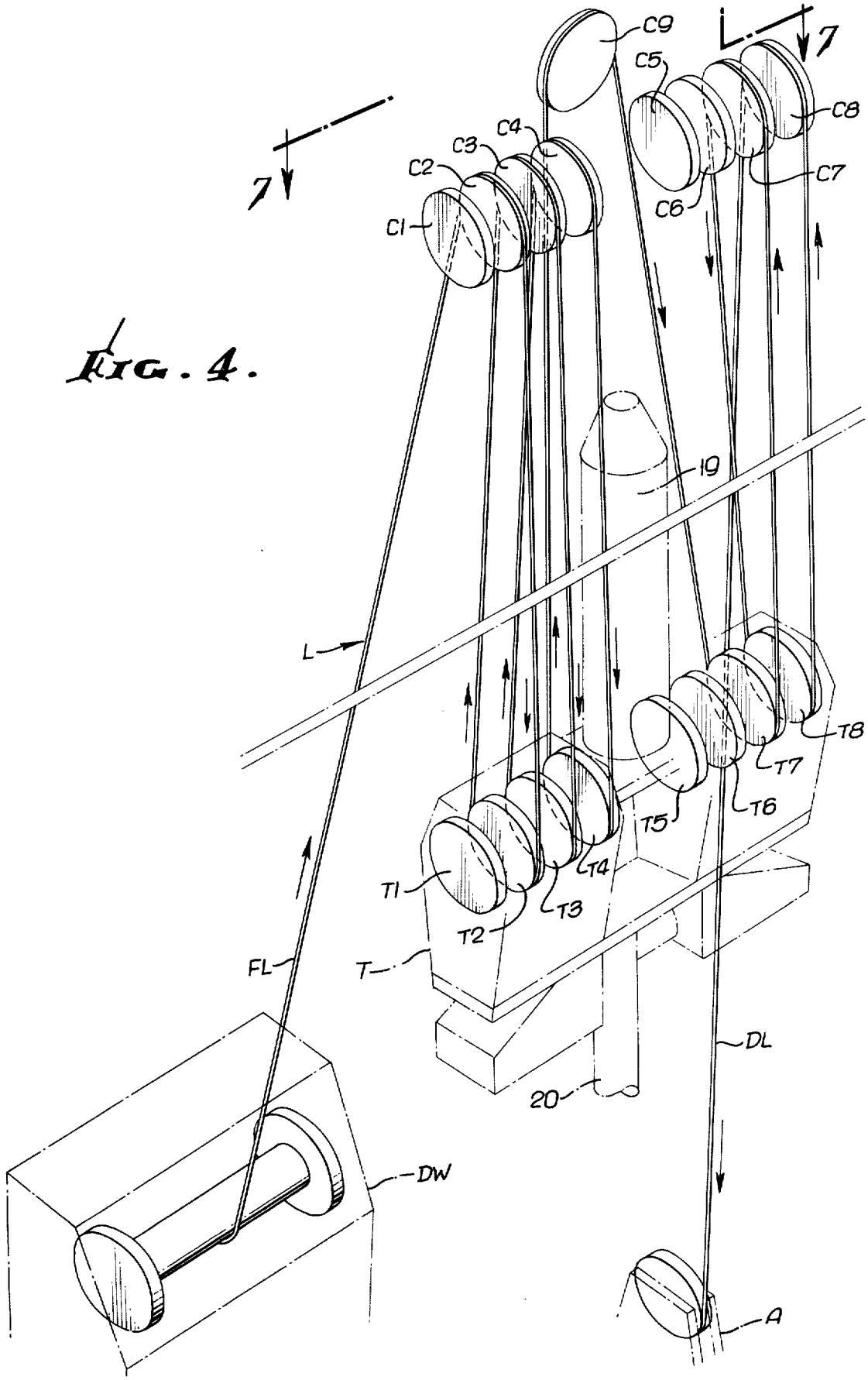
FIG. 4 is a view generally corresponding to FIG. 3, but showing the sheaves strung with ten lines.
Figure 7:
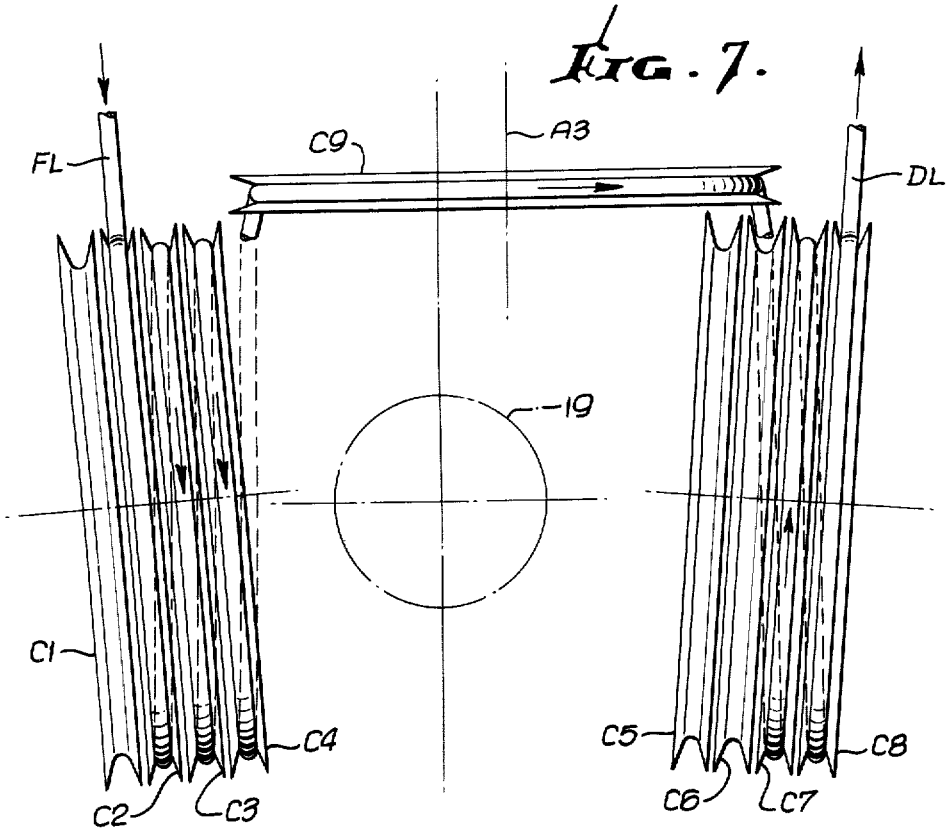
FIG. 7 is a diagrammatic top plan of the crown block strung as in FIG. 4, and taken on the line 7—7 of FIG. 4.

As seen in FIGS. 4 and 7, the crown block and traveling block are strung with ten lines with the fast line FL extending upwardly over the next to the outermost crown block sheave C2, then around the next to the outermost traveling block sheave T2, and progressively about the next adjacent inwardly spaced sheaves C3, T3, C4 and T4, and then over the crossover sheave C9, downwardly to the next to the outermost traveling block sheave T7, then about the crown block sheave C7, the traveling block sheave T8, the crown block sheave C8, and then to the dead line anchor A. In this form with the line strung as just described, the axis A3 of the crossover sheave C9 is adjusted further to the right of the line intersecting the center of the motion compensating cylinder 19, as seen in FIG. 7, to minimize fleet angle and line flexure. In this scheme, with the load supported by ten lines, the lines are reeved first about the three innermost crown and traveling block sheaves, closest to the center of the load supporting means and from the crossover sheave about the two outermost crown block and traveling block sheaves most remote from the center of the load supporting means. Thus, as seen in FIG. 7, there is a difference in the moment arms at opposite sides of the center of the load supporting means cylinder 19 which tends to centralize or equalize the imbalanced forces about the center of gravity of the traveling block.

Figure 5:
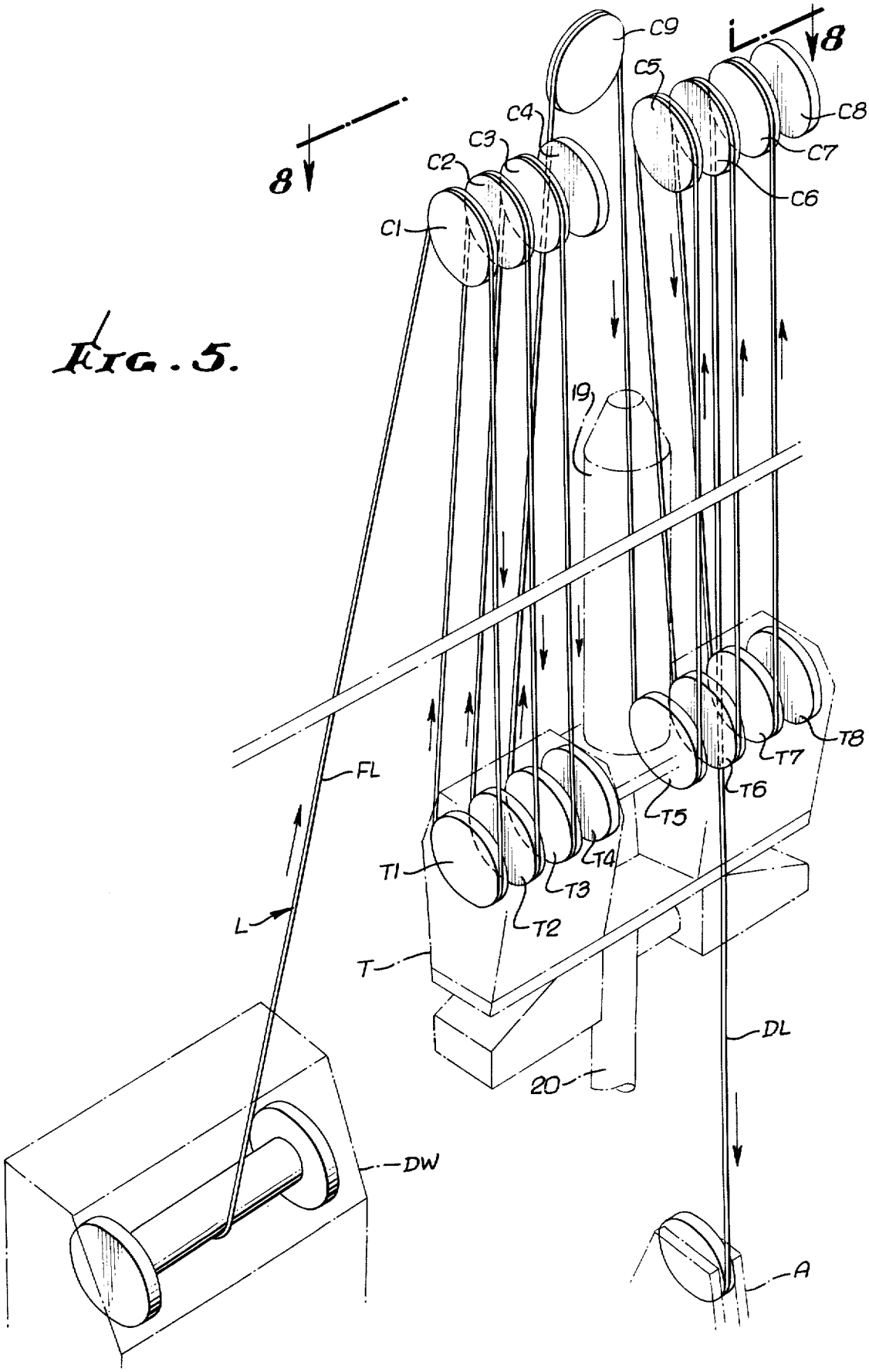
FIG. 5 is another view generally corresponding to FIG. 3, but showing the sheaves strung with 12 lines.
Figure 8:
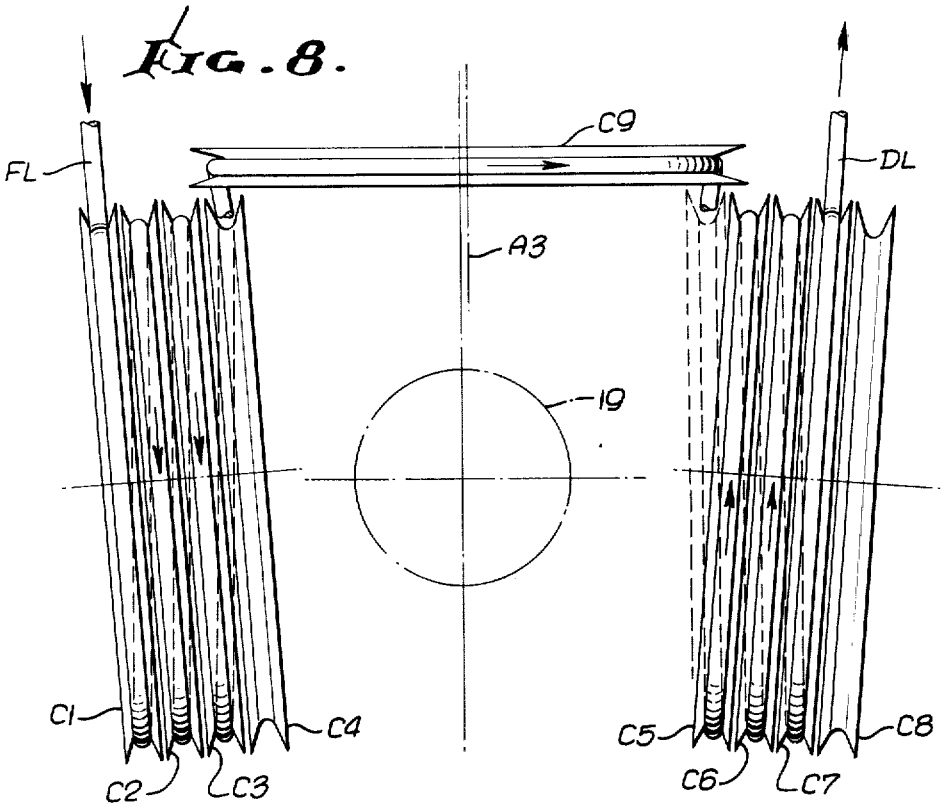
FIG. 8 is a diagrammatic top plan of the crown block strung as in FIG. 5, and taken on the line 8—8 of FIG. 5.

Referring to FIGS. 5 and 8, the 54 inch sheaves are shown as being strung with 12 load supporting lines between the crown block and traveling block sheaves, 6 lines being at each side of the load supporting compensating cylinder 19. In this form, the line L is strung about the three outermost crown block and traveling block sheaves at the left-hand side of the cylinder 19 which extend about the successive sheaves C1, T1, C2, T2, C3 and T3, and over the crossover sheave C9 to the right-hand side of the cylinder 19, and then about the successive traveling block and crown block sheaves T5, C5, T6, C6, T7 and C7 nearest the center of the load supporting means and then to the anchor A. As seen in FIG. 8, in this form, where an equal number of lines are at each side of the crown block and traveling block sheaves, the axis A3 of the crossover sheave C9 is off-set to the right with respect to the center of the cylinder 19 to the same extent as it was off-set when the sheaves are strung with 8 lines, so as to minimize fleet angle and line flexure.

Referring to FIGS. 9 through 14, the traveling block and crown block sheaves of another specific size are shown as being strung respectively with 8 ines, 10 lines and 12 lines. In these views, the sheaves are representative of sheaves of a 60 inch diameter and the selected crossover sheave is of a 68 inch diameter.

Figure 12:
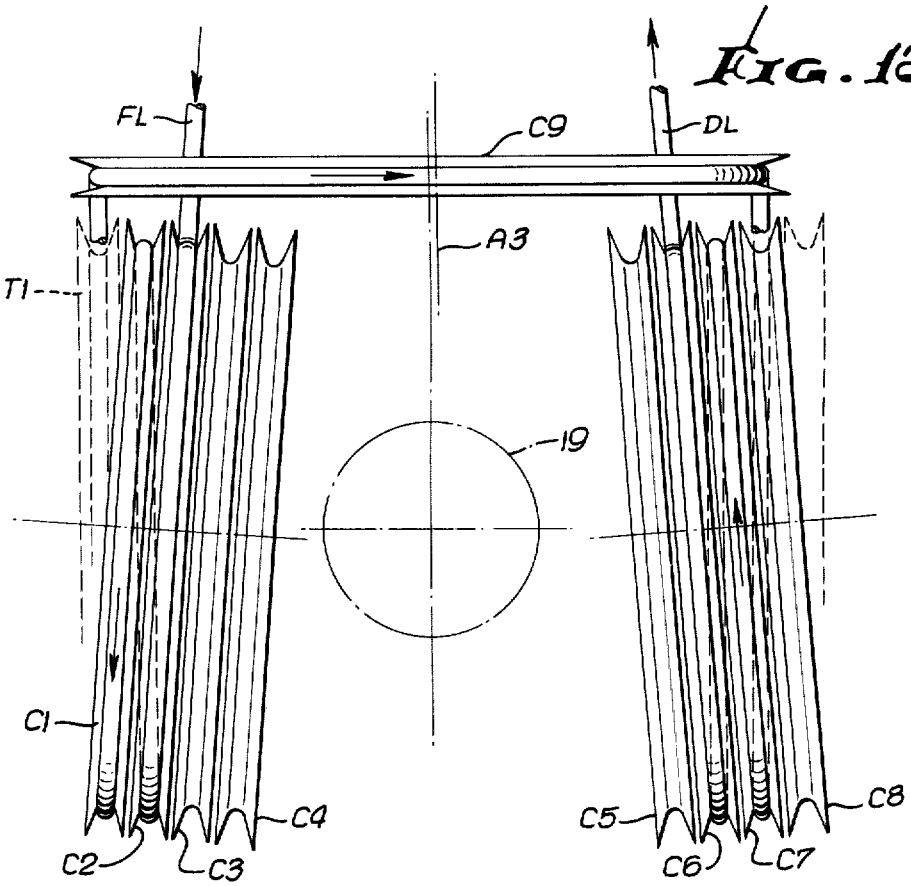
FIG. 12 is a diagrammatic top plan of the crown block strung as in FIG. 9, and taken on the line 12—12 of FIG. 9.
Figure 9:
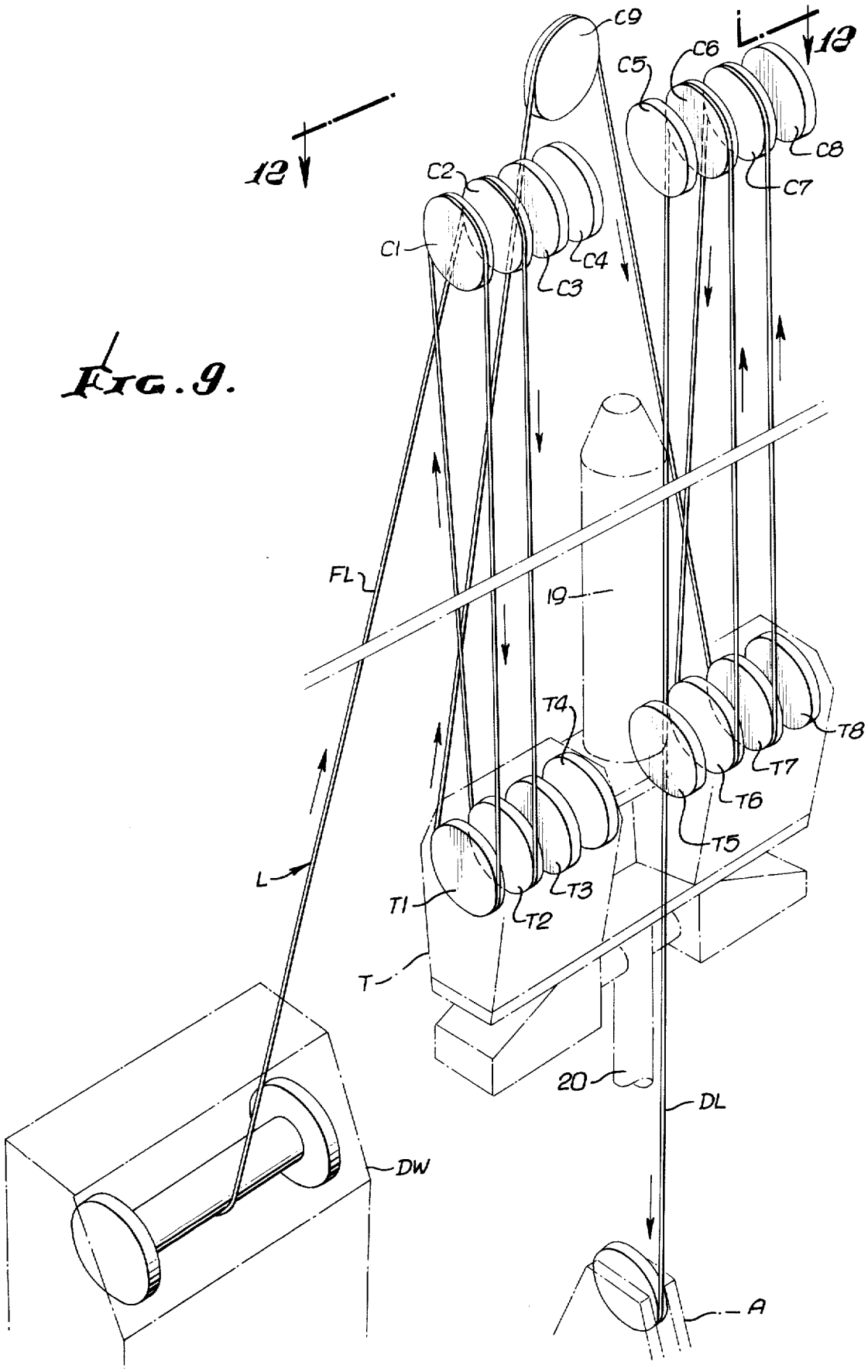
FIG. 9 is a diagrammatic illustration showing the balanced hoist apparatus strung with eight lines between the crown block and traveling block sheaves with sheaves of another particular diameter.

As seen in FIGS. 9 and 12, the sheaves are strung with 8 lines, the line L being strung on the left-hand side about the two outermost sheaves of the crown and traveling blocks. It will be noted, however, that the fast line first extends about the crown block sheave C2, then about the traveling block sheave T2, to the outer crown block sheave C1, then about the outer traveling block sheave T1, and upwardly over the crossover sheave C9, downwardly about the traveling block sheave T7, upwardly about the crown block sheave C7, then downwardly and inwardly to the traveling block sheave T6, upwardly about the crown block sheave C6 and then to the anchor A. As seen in FIG. 12, the crossover sheave C9 substantially spans the distance between the outermost crown block sheaves C1 and C8, and the crossover sheave axis A3 is slightly off-set to the right of center of the cylinder 19. In addition, the axes of the sets of crossover sheaves are skewed in the opposite direction from the axis of the 54 inch sheaves previously described so that the crown block sheaves in this embodiment diverge with respect to the crossover sheave C9 to minimize fleet angle as is clearly illustrated in FIG. 12.

Figure 10:
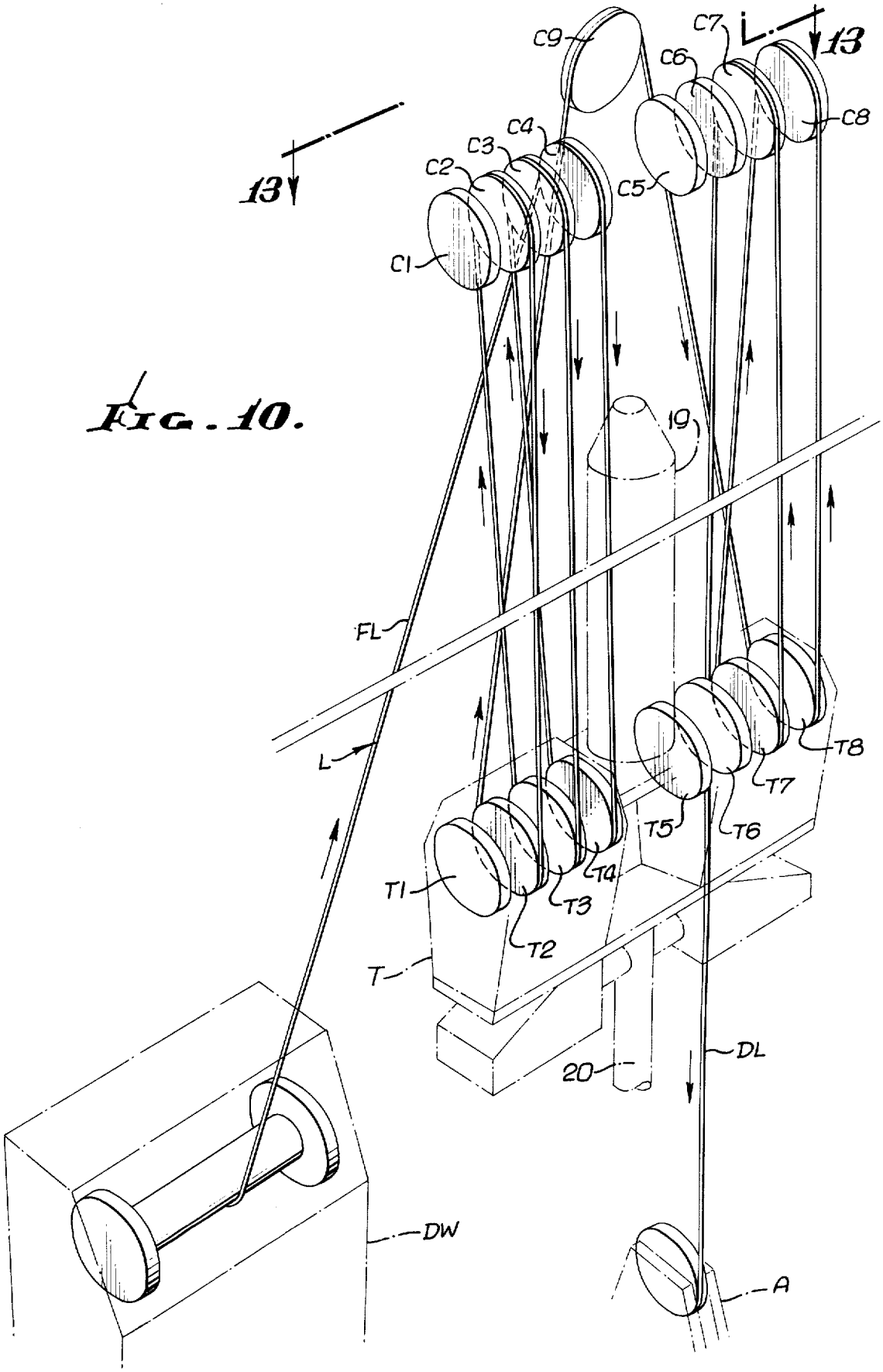
FIG. 10 is a view generally corresponding to FIG. 9, but showing the sheaves strung with ten lines.
Figure 13:
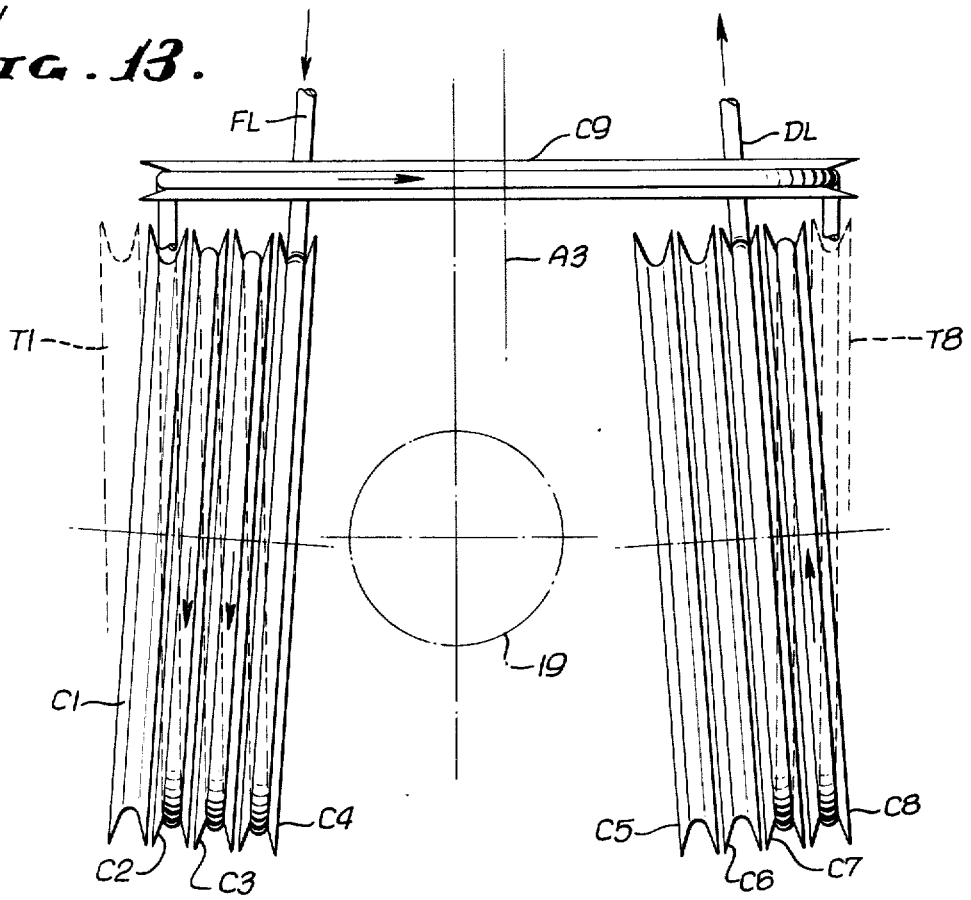
FIg. 13 is a diagrammatic top plan of the crown block strung as in FIG. 10, and taken on the line 13—13 of FIG. 10.

Referring to FIGS. 10 and 13, the 60 inch sheaves are shown as being strung with 10 lines between the crown and traveling blocks. At the left-hand side, six of the lines extend between the three innermost sheaves of the crown and traveling blocks, and at the right-hand side four of the lines extend about the outermost sheaves to substantially equalize the forces. In this scheme, the fast line FL first extends about the innermost crown block sheave C4, then progressively outwardly from the traveling block sheave T4 to the crown block sheaves C3, to the traveling block sheave T3, to the crown block sheave C2, to the traveling block sheave T2, and then upwardly over the crossover sheave C9, downwardly to the traveling block sheave T8, over the crown block sheave C8, then inwardly to the traveling block sheave T7 and to the crown block sheave C7 and then to the anchor A. Here again as seen in FIG. 13, since different numbers of lines are at the opposite sides of the center of the load, the axis A3 of the crossover sheave C9 is moved further to the right with respect to the center of the compensating cylinder 19 to minimize the fleet angle.

Figure 11:
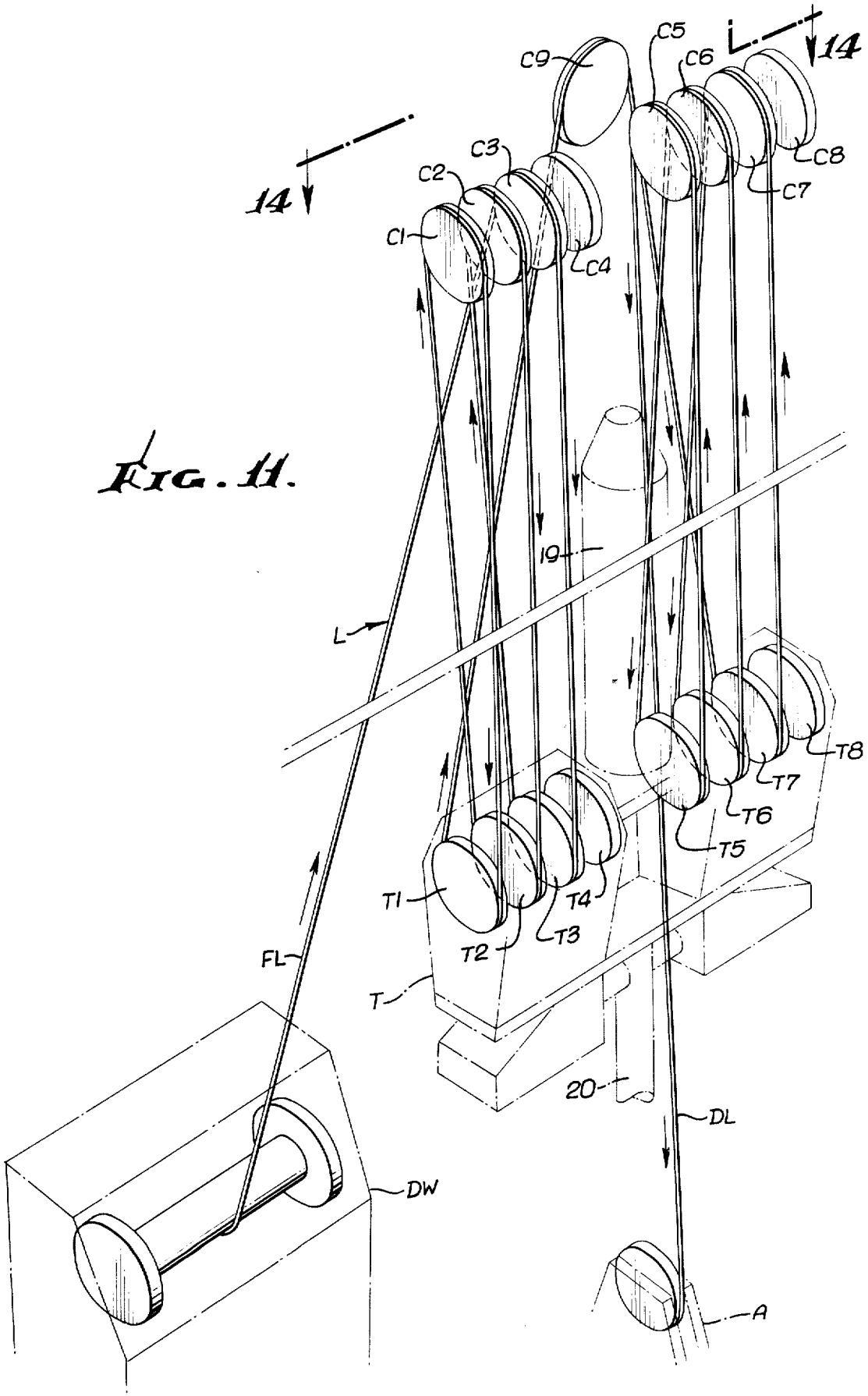
FIG. 11 is another view generally corresponding to FIG. 9, but showing the sheaves strung with 12 lines.
Figure 14:
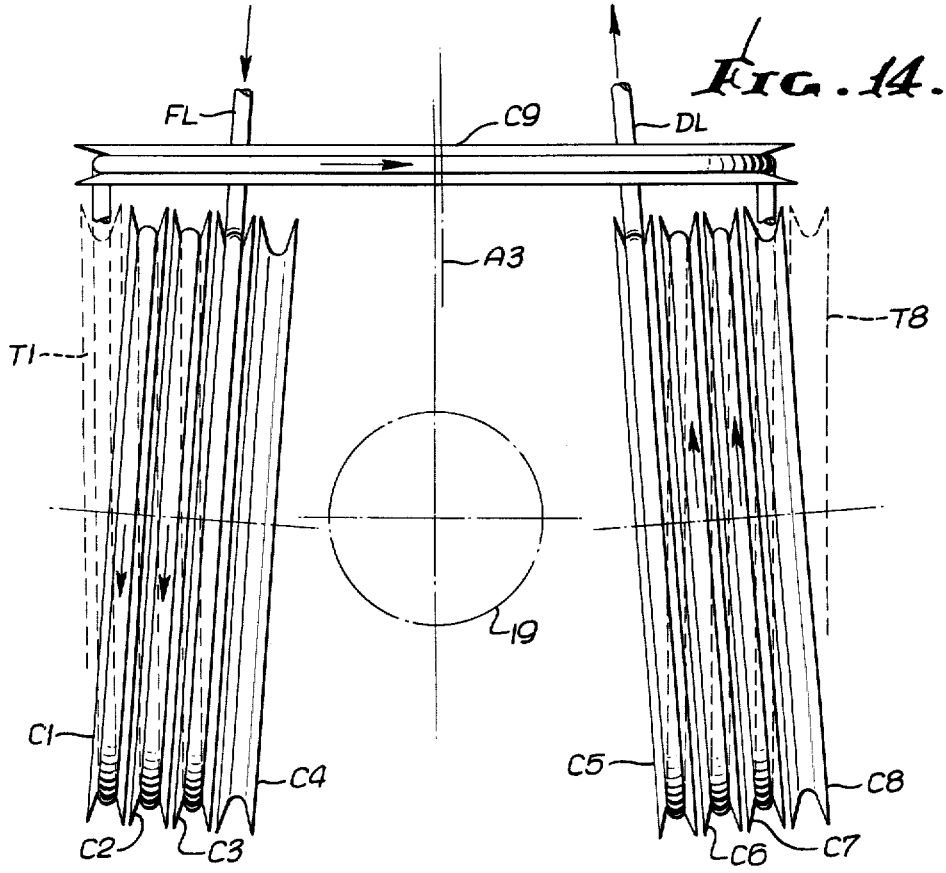
FIG. 14 is a diagrammatic top plan of the crown block strung as in FIG. 11, and taken on the line 14—4 of FIG. 11.

As seen in FIGS. 11 and 14, the 60 inch sheaves are strung with 12 lines. In this scheme, the lines are strung at the left-hand side about the three outermost crown and traveling block sheaves and at the right-hand side about the three innermost crown and traveling block sheaves. The fast line FL extends first about the innermost crown block sheave C3, progressively and outwardly about the traveling block sheave T3, to the crown block sheave C2, to the traveling block sheave T2, to the crown block sheave C1, to the traveling block sheave T1 and then upwardly over the crossover sheave C9 and to the traveling block sheave T7, then upwardly to the crown block sheave C7, downwardly about traveling block sheave T6, upwardly over the crown block sheave C6, downwardly about the traveling block sheave C5 then upwardly over the crown block sheave C5, and then to the dead line anchor A. In this scheme, since the load is supported by an equal number of lines at opposite sides of the load the axis A3 of the crossover sheave C9 is set in the same relationship with respect to the cylinder 19 as was the case of the eight line string-up of FIGS. 9 and 12.

From the foregoing it will be apparent that the invention provides a balanced hoist apparatus of the type employing a split traveling block and load support assembly, wherein the load supporting means is off center and the crown and traveling block sheaves can be reeved in selected manners with different numbers of lines, so as to equalize the forces about the center of gravity of the mass of the traveling block and load supporting structure. While the cylinder 19 is a motion compensating cylinder it will also be appreciated that other load supporting means may be connected to the traveling block frame structure, so that the center of the load support is off-set.

I claim:

1. In balanced hoist apparatus for raising and lowering a load in a derrick, crown block means at the top of the derrick and traveling block means, said block means comprising horizontally spaced sets of a plurality of crown block and traveling block sheaves at opposite sides of the center of said crown block means and said traveling block means, means supporting said sheaves for rotation about horizontal axes, said crown block means having a crossover sheave between its spaced sets of sheaves, and said traveling block means including frame means supporting said sets of sheaves of said traveling block means and having load supporting means supported by said frame means between its spaced sets of sheaves, said load supporting means being off-set to one side of the vertical center line of said traveling block means towards the set of sheaves at one side of said traveling block, drawworks means having a line extending therefrom, anchor means for the dead end of said line, said line being reeved from said drawworks about selected sheaves of the sets of sheaves at corresponding sides of said crown block means and traveling block means, about said crossover sheave and then about selected sheaves of the sets of sheaves at the corresponding other sides of said traveling block means and crown block means and supporting said traveling block means with the forces imposed on said traveling block means by said line substantially equalized about the center of gravity of the mass of said traveling block means and said load supporting means.

2. In balanced hoist apparatus as defined in claim 1, said sets of sheaves of said crown block means being on horizontal axes skewed with respect to said crossover sheave to minimize fleet angle of said line.

3. In balanced hoist apparatus as defined in claim 1, said sets of sheaves of said crown block means being on horizontal axes skewed with respect to said crossover sheave to minimize fleet angle of said line, and said crossover sheave being rotatable on a horizontal axis horizontally off-set with respect to the center of said stationary block means to minimize fleet angle.

4. In balanced hoist apparatus as defined in claim 1, said line being reeved over equal numbers of said sets of sheaves of said crown block and traveling block means, with the line extending between sheaves of said crown block sheave sets and traveling block sheave sets at the near side of said load supporting means further spaced from the center of said traveling block means than the lines extending between sheaves of said crown block sheave sets and said traveling block sheave sets at the far side of said load supporting means.

5. In balanced hoist apparatus as defined in claim 1, said line being reeved over equal numbers of said sets of sheaves of said crown block and traveling block means, with the line extending between sheaves of said crown block sheave sets and traveling block sheave sets at the near side of said load supporting means further spaced from the center of said traveling block means than the lines extending between sheaves of said crown block sheave sets and said traveling block sheave sets at the far side of said load supporting means, said line extending from said drawworks initially about said crown block sheave set and said traveling block sheave set at the near side of said load supporting means.

6. In balanced hoist apparatus as defined in claim 1, said line being reeved over an odd number of sheaves of said sets of crown block and traveling block sheaves closest to said load supporting means at the near side of said load supporting means and being reeved over an even number of sheaves of said sets of crown block and traveling block sheaves farthest from said load supporting means at the far side of said load supporting means.

7. In balanced hoist apparatus as defined in claim 1, said line being reeved over an odd number of sheaves of said sets of crown block and traveling block sheaves closest to said load supporting means at the near side of said load supporting means and being reeved over an even number of sheaves of said sets of crown block and traveling block sheaves farthest from said load supporting means at the far side of said load supporting means, said line extending from said drawworks initially about said crown block sheave set and said traveling block sheave set at the near side of said load supporting means.

8. In balanced hoist apparatus as defined in claim 1, said line being reeved over equal numbers of said sets of sheaves of said crown block and traveling block means, with the line extending between sheaves of said crown block sheave sets and traveling block sheave sets at the near side of said load supporting means further spaced from the center of said traveling block means than the lines extending between sheaves of said crown block sheave sets and said traveling block sheave sets at the far side of said load supporting means, said sets of sheaves of said crown block means being on horizontal axes skewed with respect to said crossover sheave to minimize fleet angle of said line.

9. In balanced hoist apparatus as defined in claim 1, said line being reeved over an odd number of sheaves of said sets of crown block and traveling block sheaves closest to said load supporting means at the near side of said load supporting means and being reeved over an even number of sheaves of said sets of crown block and traveling block sheaves farthest from said load supporting means at the far side of said load supporting means, said sets of sheaves of said crown block means being on horizontal axes skewed with respect to said crossover sheave to minimize fleet angle of said line.

10. In balanced hoist apparatus as defined in claim 1, said line being reeved over equal numbers of said sets of sheaves of said crown block and traveling block means, with the line extending between sheaves of said crown block sheave sets and traveling block sheave sets at the near side of said load supporting means further spaced from the center of said traveling block means than the lines extending between sheaves of said crown block sheave sets and said traveling block sheave sets at the far side of said load supporting means, said sets of sheaves of said stationary block means being on horizontal axes skewed with respect to said crossover sheave to minimize fleet angle of said line, and said crossover sheave being rotatable on a horizontal axis horizontally off-set with respect to the center of said crown block means to minimize fleet angle.

11. In balanced hoist apparatus as defined in claim 1, said line being reeved over an odd number of sheaves of said sets of crown block and traveling block sheaves closest to said load supporting means at the near side of said load supporting means and being reeved over an even number of sheaves of said sets of crown block and traveling block sheaves farthest from said load supporting means at the far side of said load supporting means, said sets of sheaves of said stationary block means being on horizontal axes skewed with respect to said crossover sheave to minimize fleet angle of said line, and said crossover sheave being rotatable on a horizontal axis horizontally off-set with respect to the center of said crown block means to minimize fleet angle.

12. In balanced hoist apparatus as defined in claim 1, said load supporting means comprising an elongated cylinder extending vertically above said frame means.

13. A traveling block for balanced hoist apparatus comprising a supporting frame structure, a set of a plurality of sheaves rotatably supported by said frame structure at one side of said supporting frame structure, a set of a plurality of sheaves by said frame structure at the being substantially spaced from the other of said plurality of sheaves and also being rotatably supported by said frame structure at the other side of said supporting frame structure, and load supporting means disposed between said sets of sheaves and carried by said frame structure in off-set relation to the center of said frame structure towards one of said sets of sheaves.

14. A traveling block for balanced hoist apparatus comprising a supporting frame structure, a set of a plurality of sheaves rotatably supported at one side of said supporting frame structure, a set of a plurality of sheaves rotatably supported at the other side of said supporting frame structure, and load supporting means carried by said frame structure in off-set relation to the center of said frame structure towards one of said sets of sheaves, wherein said frame structure includes laterally spaced supporting members having shafts mounting the respective sets of sheaves, and transverse supporting means extending between and interconnecting said spaced supporting members, said load supporting means being carried by said transverse supporting means.

15. A traveling block as defined in claim 14, said load supporting means including an elongated cylinder extending longitudinally beyond said frame structure.

* * * * *

UNITED STATES PATENT OFFICE

CERTIFICATE OF CORRECTION

PATENT NO. : 3,936,034

DATED : February 3, 1976

INVENTOR(S) : EDWARD LARRALDE

It is certified that error appears in the above-identified patent and that said Letters Patent are hereby corrected as shown below:

Column 2, line 44: change "14-4" to --14-14--.

Column 5, line 31: change "ines" to --lines--.

Column 8, lines 56 and 57: cancel "by said frame structure at the".

Signed and Sealed this

Thirteenth Day of July 1976

[SEAL]

*Attest:*

RUTH C. MASON
*Attesting Officer*

C. MARSHALL DANN
*Commissioner of Patents and Trademarks*